US010015603B2

(12) United States Patent
Sabin

(10) Patent No.: US 10,015,603 B2
(45) **Date of Patent: *Jul. 3, 2018**

(54) TRANSFERRING ACOUSTIC PERFORMANCE BETWEEN TWO DEVICES

(71) Applicant: Bose Corporation, Framingham, MA (US)

(72) Inventor: Andrew Sabin, Chicago, IL (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/472,569

(22) Filed: Mar. 29, 2017

(65) Prior Publication Data

US 2017/0201837 A1 Jul. 13, 2017

Related U.S. Application Data

(63) Continuation of application No. 14/532,599, filed on Nov. 4, 2014, now Pat. No. 9,641,943.

(60) Provisional application No. 61/899,646, filed on Nov. 4, 2013.

(51) Int. Cl.
*H04R 25/00* (2006.01)

(52) U.S. Cl.
CPC ..... *H04R 25/505* (2013.01); *H04R 25/50* (2013.01); *H04R 25/55* (2013.01); *H04R 25/554* (2013.01); *H04R 25/558* (2013.01); *H04R 25/70* (2013.01); *H04R 2225/41* (2013.01); *H04R 2225/43* (2013.01); *H04R 2225/55* (2013.01)

(58) Field of Classification Search
CPC ..... H04R 25/30; H04R 25/50; H04R 25/55; H04R 25/552; H04R 25/554; H04R 25/558; H04R 25/70; H04R 2225/39; H04R 2225/41; H04R 2225/55
USPC ... 381/23.1, 58, 60, 312, 314, 315, 320, 321
See application file for complete search history.

(56) References Cited

U.S. PATENT DOCUMENTS

| | | | | |
|---|---|---|---|---|
| 6,035,050 | A | 3/2000 | Weinfurtner et al. | |
| 7,283,842 | B2 | 10/2007 | Berg | |
| 8,503,703 | B2 * | 8/2013 | Eaton | H04R 25/70 381/312 |
| 2008/0049957 | A1 | 2/2008 | Topholm | |

(Continued)

OTHER PUBLICATIONS

International Search Report and Written Opinion; PCT/US2015/021461; dated May 29, 2015; 10 pp.

(Continued)

*Primary Examiner* — Huyen D Le
(74) *Attorney, Agent, or Firm* — Fish & Richardson P.C.

(57) ABSTRACT

The technology described in this document can be embodied in a computer-implemented method that includes receiving information indicative of an acoustic transfer function of a first acoustic device, and obtaining a set of calibration parameters that represent a calibration of a second acoustic device with respect to the first acoustic device. The method includes determining a set of operating parameters for the second acoustic device based at least in part on (i) the acoustic transfer function and (ii) the calibration parameters. The second acoustic device, when configured using the set of operating parameters, produces an acoustic performance substantially same as that of the first acoustic device. The method also includes providing the set of operating parameters to the second acoustic device.

21 Claims, 3 Drawing Sheets

(56) References Cited

U.S. PATENT DOCUMENTS

| | | | |
|---|---|---|---|
| 2009/0154741 | A1 | 6/2009 | Woods et al. |
| 2012/0095528 | A1 | 4/2012 | Miller et al. |
| 2012/0183164 | A1 | 7/2012 | Foo et al. |

OTHER PUBLICATIONS

'BlarneySaunders.com' [online] "IHear You® lets you take control of your hearing"; [retrieved Jun. 16, 2015]. Retrieved from the internet: URL< http://www.blarneysaunders.com.au/ihearyou/ ; 3 pages.

'iTunes apple.com' [online]; "Starkey SoundPoint" by Starkey Laboratories, Inc. [retrieved Jun. 16, 2015]. Retrieved from the internet: URL< https://itunes.apple.com/us/app/starkey-soundpoint/id405249175?mt=8 ; 2pages.

'iTunes apple.com' [online]; "Soundhawk" by Soundhawk [retrieved Jun. 16, 2015]. Retrieved from the internet: URL< https://itunes.apple.com/us/app/soundhawk/id914207113?mt=8 ; 2 pages.

'iTunes apple.com' [online]; "CS Customizer" by Sound World solutions [retrieved Jun. 16, 2015]. Retrieved from the internet: URL< https://itunes.apple.com/us/app/cs-customizer/id727309724?mt=8 ; 2 pages.

'iTunes apple.com' [online]; "Starkey $T^2$Remote" by Starkey Laboratories [retrieved Jun. 16, 2015]. Retrieved from the internet: URL< https://itunes.apple.com/us/app/starkey-t2-remote ; 2 pages.

* cited by examiner

TRANSFERRING ACOUSTIC PERFORMANCE BETWEEN TWO DEVICES

PRIORITY CLAIM

This application is a Continuation of U.S. patent application Ser. No. 14/532,599, filed on Nov. 4, 2014, which claims priority to U.S. Provisional Application No. 61/899,646, filed on Nov. 4, 2013, the entire content of which is incorporated herein by reference.

TECHNICAL FIELD

This disclosure generally relates to devices that can be adjusted to control acoustic outputs.

BACKGROUND

Various acoustic devices can be adjusted to produce personalized acoustic outputs. For example, hearing assistance devices or instruments such as hearing aids and personal sound amplifiers can be personalized to compensate for hearing loss and/or to facilitate listening in challenging environments. Also, media playing devices such as televisions, car audio systems and home theater systems can be adjusted to produce acoustic outputs in accordance with a listening preference of a user.

SUMMARY

In one aspect, this document features a computer-implemented method that includes receiving, at one or more processing devices, information indicative of a transfer function. The transfer function represents processing of a first input signal by a first acoustic device to produce a first audio signal having particular acoustic characteristics. The method also includes obtaining a set of calibration parameters that represent a calibration of a second acoustic device with respect to the first acoustic device, and determining a set of operating parameters for the second acoustic device based at least in part on (i) the acoustic transfer function and (ii) the calibration parameters. The second acoustic device, when configured using the set of operating parameters, produces a second audio signal from a second input signal that is substantially same as, or similar to, the first input signal. The second audio signal includes acoustic characteristics substantially same as the particular acoustic characteristics. The method also includes providing the set of operating parameters to the second acoustic device.

In another aspect, this document features a system that includes memory and one or more processing devices. The one or more processing devices can be configured to receive information indicative of a transfer function, wherein the transfer function represents processing of a first input signal by a first acoustic device to produce a first audio signal having particular acoustic characteristics. The one or more processing devices are further configured to obtain a set of calibration parameters that represent a calibration of a second acoustic device with respect to the first acoustic device, and determine a set of operating parameters for the second acoustic device. The operating parameters are determined based at least in part on (i) the acoustic transfer function and (ii) the calibration parameters. The second acoustic device, when configured using the set of operating parameters, produces, from a second input signal substantially same as the first input signal, a second audio signal having acoustic characteristics substantially same as the particular acoustic characteristics. The one or more processing devices is further configured to provide the set of operating parameters to the second acoustic device.

In another aspect, this document features a machine-readable storage device having encoded thereon computer readable instructions for causing one or more processors to perform various operations. The operations include receiving information indicative of a transfer function. The transfer function represents processing of a first input signal by a first acoustic device to produce a first audio signal having particular acoustic characteristics. The operations also include obtaining a set of calibration parameters that represent a calibration of a second acoustic device with respect to the first acoustic device, and determining a set of operating parameters for the second acoustic device based at least in part on (i) the acoustic transfer function and (ii) the calibration parameters. The second acoustic device, when configured using the set of operating parameters, produces a second audio signal from a second input signal that is substantially same as, or similar to, the first input signal. The second audio signal includes acoustic characteristics substantially same as the particular acoustic characteristics. The operations further include providing the set of operating parameters to the second acoustic device.

Implementations of the above aspects can include one or more of the following.

The particular acoustic characteristics can be determined based on estimating a pressure level caused by the first audio signal. The pressure level can be estimated at a user's ear. The pressure level can be estimated in the presence of a hearing assistance device. The first acoustic device can be an adjustable device that can be adjusted to produce the first audio signal having the particular acoustic characteristics. The first acoustic device can be a portable wireless device. The second acoustic device can be a hearing assistance device. The calibration parameters can represent a mapping between (i) baseline operating parameters of the first acoustic device, and (ii) baseline operating parameters of the second acoustic device. The baseline operating parameters for each device can be configured to produce, in the respective acoustic device, an audio signal with a set of baseline acoustic characteristics. The second acoustic device can be a hearing assistance device, and the set of baseline acoustic characteristics can be represented by an insertion gain for a set of frequencies supported by the hearing assistance device. The set of operating parameters for the second acoustic device can include user-defined parameters that reflect the user's hearing preferences. The user-defined parameters can include one or more of a gain parameter, a dynamic range processing parameter, a noise reduction parameter, and a directional parameter. The set of operating parameters for the second acoustic device can be selected such that the operating parameters compensate for a difference between environments of the first and second acoustic devices. The first input signal can represent a frequency response of the first acoustic device at one or more gain levels. A storage device can be configured for storing the calibration parameters in a database. A communication engine may provide the set of operating parameters to the second acoustic device. The communication engine can also be configured for receiving the information indicative of the transfer function.

Various implementations described herein may provide one or more of the following advantages. Acoustic performance of one device can be substantially replicated in another device in spite of differences in hardware and/or software in the two devices, and/or differences in the environments of the devices. This can be particularly useful for hearing assistance devices such as hearing aids, where a time-consuming and expensive manual or expert-driven fitting process can be obviated by at least partially automating the fitting process. For example, a user may provide his hearing preferences (e.g., using a smartphone application), which is then used to determine appropriate operating parameters for the hearing assistance device. This can allow a merchant to deliver a "pre-programmed" hearing assistance device directly to a consumer, or allow easy self-fitting of a hearing assistance device by the consumer. The hearing assistance devices may also be re-programmed or fine-tuned by the consumer without multiple visits to an audiologist. In consumer electronics applications, acoustic performance of one device can be transferred to another device when a user switches devices. For example, by allowing a headset or car-audio system to be programmed in accordance with preferred settings of a home theater system, the listening preferences of the home-theater can be made portable without requiring significant readjustments of the portable systems.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

Figure 1:
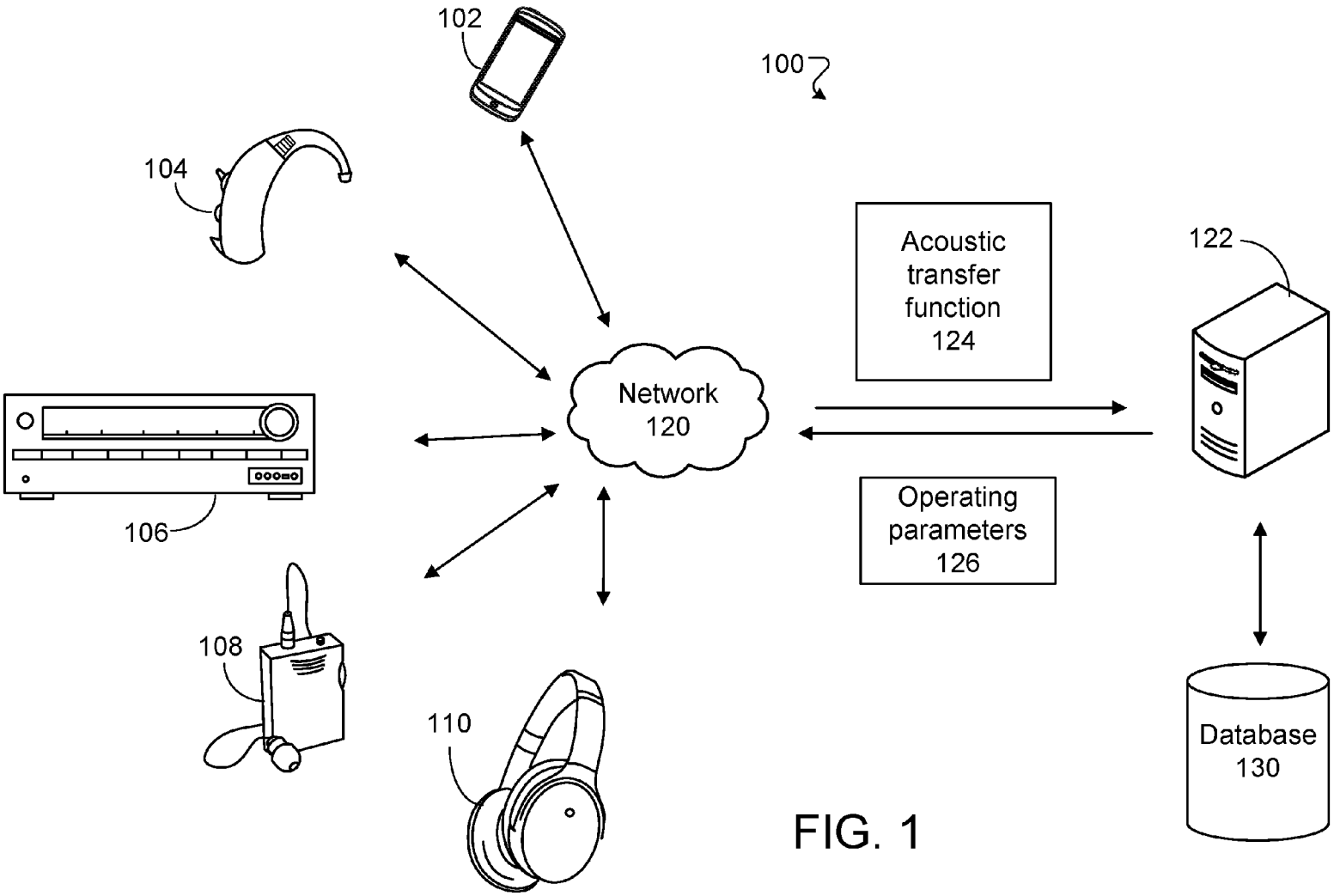
FIG. 1 is a diagram showing an example of an environment for transferring acoustic performances among devices.

This document describes technology that allows acoustic performance of one device to be ported to another device, such that the audio output from the two devices are perceived by a user to be substantially same or similar. In some cases, this can be particularly useful in adjusting or fitting hearing assistance devices such as hearing aids or personal amplification devices, but can also be used in consumer electronics applications to port an acoustic experience from one device to another.

Hearing assistance devices may require adjustment of various parameters. Such parameters can include, for example, parameters that adjust the dynamic range of a signal, gain, noise reduction parameters, and directionality parameters. In some cases, the parameters can be frequency-band specific. Selection of such parameters (often referred to as 'fitting' the device) can affect the usability of the device, as well as the user-experience. Manual fitting of hearing assistance devices can however be expensive and time-consuming, often requiring multiple visits to a clinician's office. In addition, the process may depend on effective communications between the user and the clinician. For example, the user would have to provide feedback (e.g., verbal feedback) on the acoustic performance of the device, and the clinician would have to interpret the feedback to make adjustments to the parameter values accordingly. Apart from being time-consuming and expensive, the manual fitting process thus depends on a user's ability to provide feedback, and the clinician's ability to understand and interpret the feedback accurately.

The technology described in this document allows a user to adjust a first device to obtain a desired or acceptable acoustic performance. The parameters corresponding to the desired acoustic performance on the first device can then be translated (for example, by a computing device such as a server) to a set of parameters for a second device such that the acoustic performance of the second device is substantially same, or similar to, the acoustic performance of the first device. The process can be repeated for a number of typical listening environments. The translated parameters can then be provided to the second device, and used to program the second device. In one example, a smartphone or tablet computer can be used as the first device to obtain information about the target acoustic performance, and corresponding parameters can be used for programming a hearing assistance device such as a hearing aid or personal sound amplifier.

The technology described in this document can also be used, for example, to port the acoustic performance of one device to another. For example, if a user sets a home theater system to obtain a desired acoustic performance, corresponding parameters can be determined and provided to the user's car audio system such that the same or similar acoustic performance is produced by the car audio system without the user having to make significant adjustments to the system. This can also be useful, for example, when an acoustic device is replaced by another one. Particularly for devices with a large number of controllable parameters, the automatic porting of acoustic performance may allow for efficient replacement of one device with another.

FIG. 1 shows an example environment 100 for transferring acoustic performances among devices. The environment 100 includes various acoustic devices that can communicate, for example, over a network 120, with a remote computing device such as a server 122. Examples of the acoustic devices include a handheld device 102 (e.g., a smartphone, tablet, or e-reader), a media playing device 106 (e.g., a home theater receiver), or a headset 110. The acoustic devices can also include hearing assistance devices such as a hearing aid 104 or a personal amplification device 108 (e.g., a portable speaker). Other examples of such devices can include car audio systems, cochlear implants, or large scale acoustic systems such as systems installed in theaters and auditoriums. Acoustic performance of one device (e.g., a handheld device 102) may be transferred or ported to another device (e.g., a hearing aid 104) by determining operating parameters configured to produce a substantially same or similar acoustic performance in the latter device.

The primary illustrative example used in this document involves transferring of an acoustic performance from a handheld device 102 to a hearing assistance device such as a hearing aid 104 or a personal amplification device 108. However, transferring acoustic performances between other acoustic devices are within the scope of the disclosure. For example, the technology described in this document can be used for transferring acoustic performance of a media player 106 to a headset 110. In another example, the acoustic performance of a home theater system can be transferred using the technology to a car audio system.

In some implementations, acoustic performance of a device refers to an ability of the device to produce an audio signal with particular acoustic characteristics from an input signal. The acoustic performance of a device can be subjective, and depend on a user's perception of an audio signal.

Objective characterization of acoustic performance can be done, for example, by quantitatively measuring or estimating an effect (e.g., a pressure level) caused by an audio signal. For example, to quantitatively assess an acoustic performance of a device for a particular frequency (or frequency range) and amplitude, the pressure level or pressure profile created by the corresponding audio signal can be measured or estimated at or near the user's ear. The measurement or estimation can be performed, for example, for a point in space inside the user's ear canal, or at the eardrum, to represent acoustic performance as a function of a measurable physical parameter. Such measurements can be made, for example, by placing a sensor at or near the point of measurement. In some implementations, the measurements are made by placing the sensor within the ear canal of a human subject, or in an artificial structure designed to represent the ear canal of a human subject. In some implementations, the measurement is made using a model of the acoustics of the device and/or the measurement location.

For hearing assistance devices such as a hearing aid 104, acoustic performance can be measured via a parameter known as the Real Ear Insertion Gain (REIG). In some implementations, REIG for a device can be represented as the difference in sound pressure levels at the eardrum for the same audio signal between: (i) when the device is not present and (ii) when the device is in the ear and turned on. As the device provides more amplification, REIG increases. In some implementations, REIG can be represented as a frequency vs. gain function (also referred to as a frequency-gain curve (FGC)), that varies based on the sound pressure level of the input signal.

In some implementations, the FGC can be derived from an audiogram, and subsequently fine-tuned based on a perception of the user. For example, the shape of the FGC can be fine-tuned if the audiogram based settings result in a perceived hollow, booming, or metallic sound. For example, users may modify the shape of FGC to better suit their preference (e.g., to make the acoustic performance less booming, or less metallic). In some implementations, such fine tuning of the FGC shapes can be accomplished using an adjustable initial device.

In some implementations, the initial device is a wireless handheld device 102 (e.g., a smartphone or tablet computer), and the target device is a hearing assistance device such as a hearing aid 104 or a personal amplification device 108. In such cases, fitting of the hearing assistance device can be facilitated via providing adjustment capabilities on the handheld device 102, and transferring the resulting acoustic performance to the hearing assistance device. In some implementations, the transfer of the acoustic performance between the two devices can be facilitated by a remote computing device such as a server 122. In some implementations, information about the acoustic performance of the initial device (the handheld device 102 in this example) is provided to the server 122, which determines a corresponding set of operating parameters 126 for the target device (the hearing assistance device in this example). The calibration parameters used in the determination of the operating parameters 126 can be stored in a database 130 accessible to the server 122. The acoustic performance of the initial device can be represented, for example, by an acoustic transfer function 124 that represents how the initial device processes a particular input signal to produce the acoustic performance. The communications among the initial device, the target device, and the server 122 can be facilitated by a network 120 to which the various devices are connected.

The initial device can be configured to include capabilities for obtaining information about a target acoustic performance. If the obtained information is eventually used for fitting or adjusting a target device, the initial device can be configured to include functionalities of the target device. For example, if the initial device is a handheld device 102 (e.g., a smartphone or tablet), and the target device is a hearing aid 104, the handheld device 102 is configured to pick-up, process, and deliver to the ears of a user, the sounds around the user. For a handheld device 102, the sounds can be picked up using a microphone, amplified and/or otherwise processed, and delivered to a user's ears, for example, via earphones or other speaker devices connected to the handheld device.

The initial device can be configured to include well-characterized software and/or hardware components so that the acoustic output of the initial device for a given input signal and operating parameters is predictable. In some implementations, the acoustic output of the initial device can be characterized using an acoustic transfer function 124 that represents the processing of an input signal by the initial device to produce an acoustic output (or audio signal). The acoustic transfer function 124 can represent the effects of various components (e.g., linear, or non-linear components) used in processing the input signal to produce the acoustic output. For example, the acoustic transfer function can represent the contribution of one or more of: a hardware module, a software module, a microphone, an acoustic transducer, a wired connection, a wireless connection, a noise source, a processor, a filter, or an environment associated with the initial device. In the example of a handheld device 102, the acoustic transfer function 124 can represent the various components in the processing path between the microphone that picks up the sounds in the environment, and the speakers that provide a corresponding acoustic output to a user's ear.

The initial device is configured to allow the user to adjust parameter values, possibly in real time. Adjustments can be made as the nature of input changes, to achieve a desired acoustic performance. In some implementations, various controls can be provided on the initial device to allow the user to make such adjustments. The number of adjustable parameters and controls can be configured based on a level of expertise of a user performing the adjustments. For example, if the adjustments are made by a clinician (e.g., based on feedback from a user listening to the resultant output), a high degree of configurability can be provided on the initial device, for example, by providing one or more controls for individual frequency channels. However, in some cases, the users may not have adequate expertise to handle such high degree of configurability. In such cases, a simplified and/or intuitive adjustment interface can be provided for the user to select a target acoustic performance.

Figure 2:
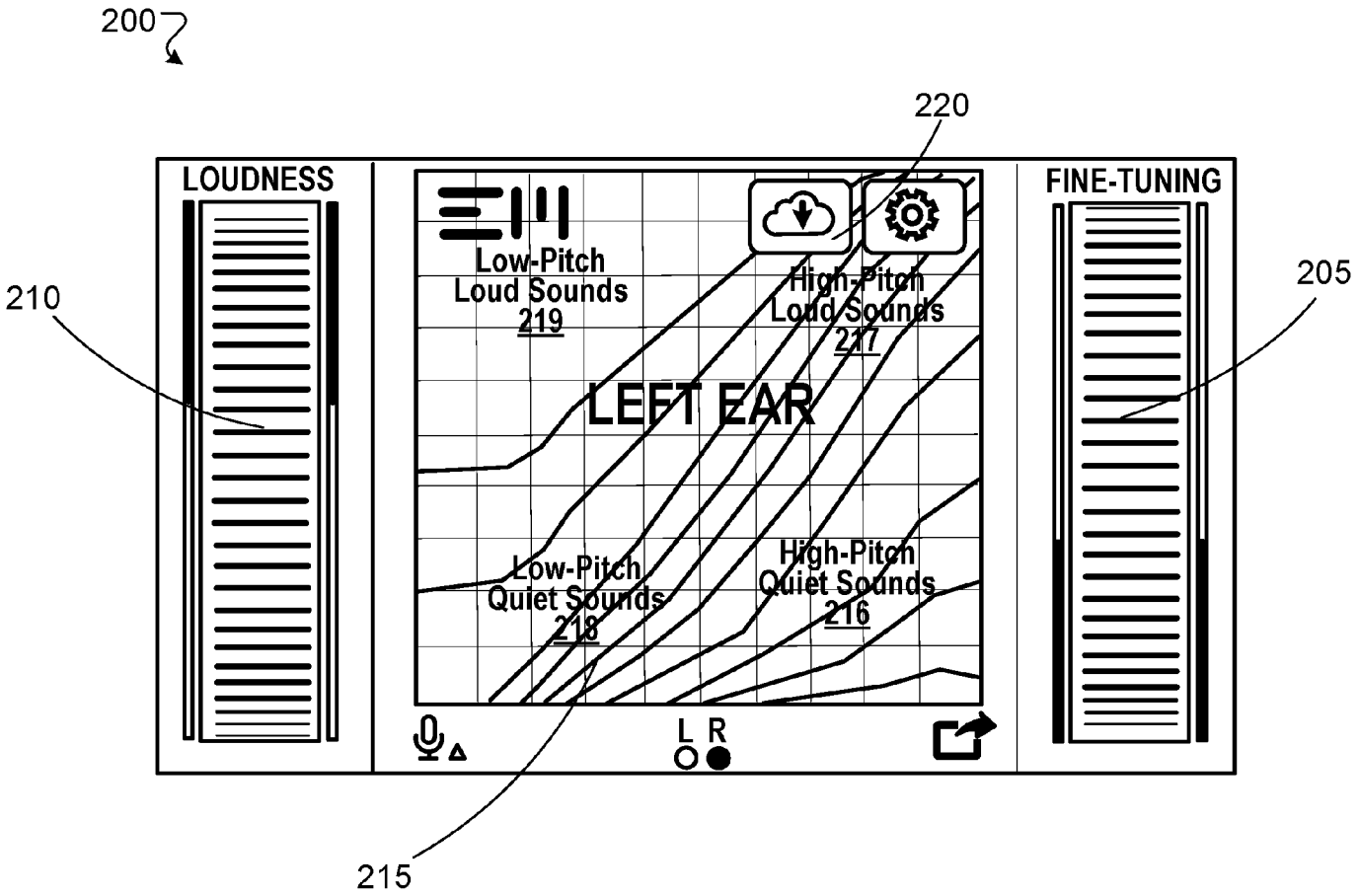
FIG. 2 shows an example of a screenshot for adjusting hearing preferences.

In some implementations, the adjustment interface can be provided via an application that executes on the initial device. An example of such an interface 200 is shown in FIG. 2. The interface 200 can include, for example, a control 205 for selecting frequency ranges at which amplification is needed, and a control 210 for adjusting the gain for the selected frequency ranges. On a touch screen display device, the controls 205 and 210 represents scroll-wheels that can be scrolled up or down to select desired settings. Other types of controls, including, for example, selectable buttons, fillable forms, text boxes, etc. are also possible.

The interface 200 can also include a visualization window 215 that graphically represents how the adjustments made using the controls 205 and 210 affect the processing of the input signals. For example, the visualization window 215 can represent (e.g., in a color coded fashion, or via another representation) the effect of the processing on various types of sounds, including, for example, low-pitch loud sounds, high-pitch loud sounds, low-pitch quiet sounds, and high-pitch quiet sounds. The visualization window 215 can be configured to vary dynamically as the user makes adjustments using the controls 205 and 210, thereby providing the user with real-time visual feedback on how the changes would affect the processing. In the particular example shown in FIG. 2, the shades in the quadrant 216 of visualization window 215 shows that the selected settings would amplify the high-pitch quiet sounds the most. The shades in the quadrants 217 and 218 indicate that the amplification of the high-pitch loud sounds and low-pitch quiet sounds, respectively, would be less as compared to the sounds represented in the quadrant 216. The absence of any shade in the quadrant 219 indicates that the low-pitch loud sounds would be amplified the least. Such real time visual feedback allows the user to select the settings not only based on what sounds better, but also on a priori knowledge of the nature of the hearing loss.

The interface 200 can be configured based on a desired amount of details and functionalities. In some implementations, the interface 200 can include a control 220 for saving the selected settings and/or providing the selected settings to a remote device such as a server or a remote storage device. Separate configurability for each ear can also be provided. In some implementations, the interface 200 can allow a user to input information based on an audiogram such that the settings can be automatically adjusted based on the nature of the audiogram. For example, if the audiogram indicates that the user has moderate to severe hearing loss at high frequencies, but only mild to moderate loss at low frequencies, the settings can be automatically adjusted to provide the required compensation accordingly. In some implementations, where the initial device is equipped with a camera (e.g., if the initial device is a smartphone), the interface 200 can provide a control for capturing an image of an audiogram from which the settings can be determined. In some implementations, the interface 200 can be used for controlling a device different from the device on which the interface 200 is presented. For example, the interface 200 can be presented on a smartphone, but the user-input obtained via the interface 200 can be used for adjusting a separate initial device (e.g., a media player or a personal amplification device).

The initial hearing device may also be configured to transfer information about a target acoustic performance to a remote computing device such as a server 122. In some implementations, the initial device can include wireless or wired connectivity to communicate with the remote computing device. In some implementations, the connectivity can be provided via an auxiliary network connected device. For example, the initial device may be tethered to a connected device such as a laptop computer to transfer information about the target acoustic performance to the remote computing device.

The initial device can be adjusted in a variety of listening environments using, for example, the interface 200. For example, a user can adjust the initial device while having a conversation with another individual in a noisy restaurant until a desired acoustic performance is achieved. Similarly, the user may readjust the settings at a concert hall while listening to an orchestra. The corresponding settings can be stored either locally on the device itself or at a remote storage location, connected over the Internet. Multiple settings can be created and stored for the same or similar locations. Further, the user can specify which settings should be transferred to the target device. For example, if a hearing aid is the target instrument, the user can specify separate settings corresponding to the "quiet speech" and "noisy speech" settings on the target device.

The information obtained by the initial device is used for determining operating parameters for a target device. In some implementations, the determination can be made at a remote computing device such as the server 122. The determination can also be done, for example, at the initial device and provided to the target device directly. For example, if the initial device is a smartphone and the target device is a personal amplification device 108 or wireless headset 110, the operating parameters can be determined at the initial device and provided directly to the device 108 or 110, for example, over a Bluetooth or Wi-Fi connection. In some implementations, the operating parameters for the target device may also be determined at the target device based on information received from the initial device.

Determining operating parameters for the target device includes translating the particular settings from the initial device to the analogous parameter values for the target device. This includes determining parameter values for the target device to produce an acoustic output in the ear of the user that substantially matches the acoustic output of the initial device under the particular settings. Various additional factors may have to be compensated for during the translation process. Examples of such additional factors include, for example, coupling of the target device with the ear, an extent to which unamplified sounds enter the ear, the limitations of the target device, and the number of different processing channels on the target device. In some implementations, such additional factors are characterized separately for each pair of initial device and target device, and captured as part of a set of calibration parameters corresponding to the pair of devices.

Calibration parameters can be determined, for example, based on comparing operating parameters for producing a baseline acoustic performance in each of the two devices. For hearing assistance devices, such a baseline acoustic performance can be represented, for example, in terms of the amount of linear amplification needed to reach a particular REIG value (e.g., an REIG value of 0). The baseline can be configured to compensate for the various inherent differences between the devices, including, for example, differences in structures, operations, or environments, as well as one or more of the additional factors mentioned above. For instance, a hearing assistance device that completely occludes the ear canal (e.g., a completely-in-canal (CIC) hearing aid, or an invisible-in-canal (IIC) hearing aid) may need significant amplification to overcome the occlusion loss caused by the presence of the device and achieve a particular REIG value. In contrast, a hearing assistance device that does not occlude the ear canal, or occludes the ear canal only partially (e.g., a behind-ear hearing aid, or a personal amplification device) may require relatively less amplification to reach the same REIG value. The difference in FGC curves between the two types of devices can represent relative calibration parameters between the two types of devices.

Once the calibration parameters are obtained, one device can be calibrated with respect to another based on such calibration parameters. For example, if the calibration parameters between an initial device and target device for zero REIG is applied to the target device, the target device can be expected to produce identical or at least similar acoustic performance as that of the initial device (assuming that the hardware and/or software capabilities of the target device allow such an acoustic performance). The calibration parameters can be applied, for example, via a tunable filter in the second device configured to function as a calibration filter. Upon calibration, user-specific operating parameters (e.g., signal processing parameters that represent the user-preferences associated with compression, gain, noise reduction, directional processing, etc.) can be applied to the target device. The user-specific parameters can be used for producing personalized audio outputs which could also be situation-specific. For example, for a hearing assistance device, the user-specific parameters can be based on user preferences or a nature of hearing loss for the user, and vary based on whether the user is in a quiet or loud environment, and/or whether the user is listening to music or speech.

In some implementations, determining the calibration parameters requires specialized measurement equipment such as a real ear measurement system or a manikin ear that has acoustic properties similar to a human ear. However, the calibration parameters need to be determined only once for each combination of initial and target devices. Once determined, the calibration parameters can be stored, for example, in a database 130 accessible to the computing device determining the operating parameters for the target device.

Figure 3:
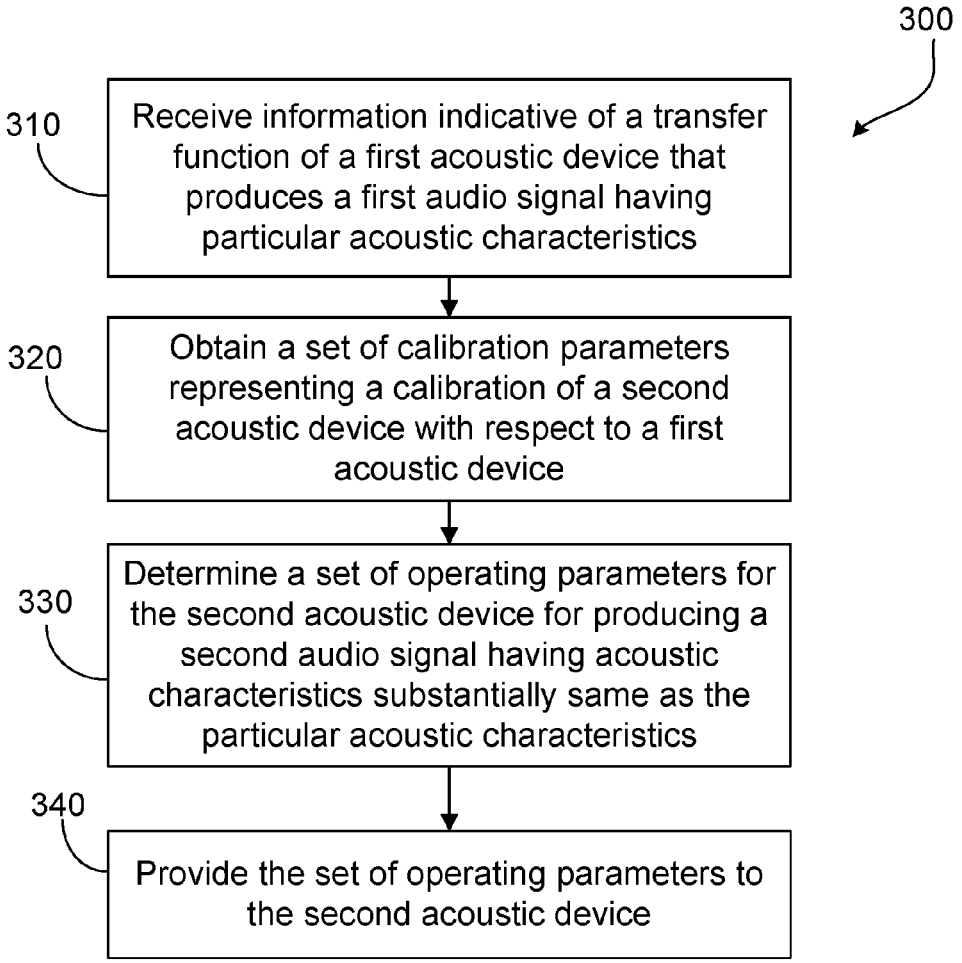
FIG. 3 is a flowchart of an example process for transferring acoustic performance of one device to another.

FIG. 3 shows a flowchart of an example process 300 for transferring acoustic performance of one device to another. The operations of the process 300 can be performed on one or more of the devices described above with respect to FIG. 1. In some implementations, at least a portion of the process 300 can be performed by a server 122 that is configured to communicate with one or both of the initial device and the target device. Portions of the process 300 can also be performed at one or more of the initial device or the target device.

The operations of the process 300 include receiving information indicative of an acoustic transfer function of an initial device that produces a first audio signal having particular acoustic characteristics (310). The acoustic transfer function can represent processing of a first input signal by the initial device to produce the first audio signal. The acoustic characteristics of the first audio signal can represent the target acoustic performance that the user desires to transfer to a target device such as a hearing assistance device.

The operations further include obtaining a set of calibration parameters that represent a calibration of a target device with respect to the initial device (320). In some implementations, the set of calibration parameters are obtained by accessing a database that stores calibration parameters for various pairs of initial and target devices. This can be done, for example, by querying the database based on an identification of the initial and target devices.

The operations also include determining a set of operating parameters for the target device for producing a second audio signal having acoustic characteristics substantially same as the particular acoustic characteristics produced by the initial device (330). In some implementations, the set of operating parameters are determined based at least in part on the acoustic transfer function and the obtained calibration parameters. This can include, for example, modifying the acoustic transfer function of the initial device based on the calibration parameters to determine an acoustic transfer function of the target device, and determining the set of operating parameters for the target device based on the acoustic transfer function of the target device. In some implementations, the target device, when configured using the determined operating parameters, replicates the acoustic performance of the initial device.

The operations further include providing the set of operating parameters to the target device (340). In some implementations, the set of operating parameters can be provided to the target device directly (e.g., when the target device itself is communicating with the server 122 or another computing device that determines the operating parameters), or via an intermediate device (e.g., a computing device capable of communicating with the server 122 or another computing device that determines the operating parameters). In some implementations, the operating parameters can be provided to the target device by a communication engine of the server 122. The communication engine can include one or more processors. In some implementations, the communication engine can include a transmitter for transmitting the operating parameters to the target device. In some implementations, the communication engine can also be configured to receive, from the initial device, information related to the transfer function of the initial device.

In some implementations, the process 300 enables user-controlled selection and programming of acoustic devices. For example, a target device can be selected based on determining which devices can be configured to produce the desired acoustic performance. Accordingly, only devices capable of producing the desired acoustic performance can be offered for sale to a user, thereby automatically excluding devices that the user will likely not select anyway. Acoustic devices that can be offered for sale this way can include, for example, hearing aids, portable speakers, car audio systems, and home theater systems.

The technology described in this document can facilitate buying pre-programmed acoustic devices such as hearing aids and personal amplification devices. For example, a user can purchase a target device such as a hearing aid online, and use an initial device to provide information related to the desired acoustic performance. Corresponding operating parameters for the hearing aid can then be obtained by a distributor or retailer of the hearing aid, and used for programming the purchased device. The programmed device can then be mailed to the user, who can start using the device out-of-the-box, without visiting a clinician to get the device fitted.

The technology described in this document can also allow users to program acoustic devices themselves. For example, if the device is programmable via a direct connectivity, or via an intermediate device, the operating parameters can be downloaded to the device by a user. In some implementations, a user can provide the preferred acoustic performance via a personal computer or a mobile device, and download correspond operating parameters for the target device. The technology also allows for reprogramming acoustic devices, for example, in the event the operating parameters deviate from the set values over time, or if the user's preference for an acoustic performance changes (e.g., due to changes in the user's hearing loss over time). Such reprogramming can be done by a distributor/retailer of the device, or even by the user.

The technology described herein also allows for a transfer of acoustic preferences across entertainment devices such as media players, home theater systems and car audio systems. This can be done, for example, based on calibration parameters determined via standard measurements on pairs of devices. In one example, a test signal is played out of a car audio system (i.e., an example initial device) and measured (or modeled) at a user's ear. The same procedure is then repeated for a target device (e.g., a home theater system). The calibration parameters thus obtained can then be used to compensate for differences in devices/listening environments. The differences can be determined, for example, by characterizing the devices, or measuring parameters of the listening environments. In some implementations, user preference parameters (e.g., equalizer settings) can also be applied for an improved acoustic performance transfer.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A computer-implemented method comprising:

receiving, at one or more processing devices, information indicative of a transfer function, wherein the transfer function represents processing of a first input signal by a first acoustic device to produce a first audio signal having particular acoustic characteristics;

obtaining a set of calibration parameters representing an adjustment for at least one operating parameter of a second acoustic device based on an operating parameter of the first acoustic device, the adjustment being based on an acoustic characteristic of the first acoustic device and an acoustic characteristic of the second acoustic device;

determining a set of operating parameters that includes the at least one operating parameter for the second acoustic device based at least in part on (i) the transfer function and (ii) the calibration parameters representing the adjustment, such that the second acoustic device, when configured using the set of operating parameters, produces, from a second input signal substantially same as the first input signal, a second audio signal having acoustic characteristics substantially same as the particular acoustic characteristics; and providing the set of operating parameters to the second acoustic device.

2. The method of claim 1, wherein the particular acoustic characteristics are determined based on estimating a pressure level caused by the first audio signal.

3. The method of claim 2, wherein the pressure level is estimated at a user's ear.

4. The method of claim 2, wherein the pressure level is estimated in the presence of a hearing assistance device.

5. The method of claim 1, wherein the first acoustic device is an adjustable device that can be adjusted to produce the first audio signal having the particular acoustic characteristics.

6. The method of claim 5, wherein the first acoustic device is a portable wireless device.

7. The method of claim 1, wherein the second acoustic device is a hearing assistance device.

8. The method of claim 1, wherein the second acoustic device is a hearing assistance device, and the set of operating parameters is represented by an insertion gain for a set of frequencies supported by the hearing assistance device.

9. The method of claim 1, wherein the set of operating parameters for the second acoustic device comprises user-defined parameters that reflect the user's hearing preferences.

10. The method of claim 9, wherein the user-defined parameters comprise one or more of a gain parameter, a dynamic range processing parameter, a noise reduction parameter, and a directional parameter.

11. The method of claim 1, wherein the set of operating parameters for the second acoustic device are selected such that the operating parameters are configured to compensate for a difference between environments in which the first and second acoustic devices are deployed.

12. The method of claim 1, wherein the first input signal represents a frequency response of the first acoustic device at one or more gain levels.

13. The method of claim 1, wherein the first acoustic device comprises a first type of device, and wherein the second acoustic device comprises a second type of device that is different from the first type.

14. A system comprising:

memory; and one or more processors configured to:

receive information indicative of a transfer function, wherein the transfer function represents processing of a first input signal by a first acoustic device to produce a first audio signal having particular acoustic characteristics;

obtain a set of calibration parameters representing an adjustment for at least one operating parameter of a second acoustic device based on an operating parameter of the first acoustic device, the adjustment being based on an acoustic characteristic of the first acoustic device and an acoustic characteristic of the second acoustic device;

determine a set of operating parameters that includes the at least one operating parameter for the second acoustic device based at least in part on (i) the transfer function and (ii) the calibration parameters representing the adjustment, such that the second acoustic device, when configured using the set of operating parameters, produces, from a second input signal substantially same as the first input signal, a second audio signal having acoustic characteristics substantially same as the particular acoustic characteristics; and provide the set of operating parameters to the second acoustic device.

15. The system of claim 14, further comprising a storage device for storing the calibration parameters in a database.

16. The system of claim 14, further comprising a communication engine for providing the set of operating parameters to the second acoustic device.

17. The system of claim 14, further comprising a communication engine for receiving the information indicative of the transfer function.

18. The system of claim 14, wherein the first acoustic device is a portable wireless device, and the second acoustic device is a hearing assistance device.

19. One or more non-transitory machine-readable storage devices having encoded thereon computer readable instructions for causing one or more processors to perform operations comprising:

receiving information indicative of a transfer function, wherein the transfer function represents processing of a first input signal by a first acoustic device to produce a first audio signal having particular acoustic characteristics;

obtaining a set of calibration parameters representing an adjustment for at least one operating parameter of a second acoustic device based on an operating parameter of the first acoustic device, the adjustment being based on an acoustic characteristic of the first acoustic device and an acoustic characteristic of the second acoustic device;

determining a set of operating parameters that includes the at least one operating parameter for the second acoustic device based at least in part on (i) the transfer function and (ii) the calibration parameters representing the adjustment, such that the second acoustic device, when configured using the set of operating parameters, produces, from a second input signal substantially same as the first input signal, a second audio signal having acoustic characteristics substantially same as the particular acoustic characteristics; and providing the set of operating parameters to the second acoustic device.

20. The one or more non-transitory machine-readable storage devices of claim 19, wherein the first acoustic device is adjustable to produce the first audio signal as having the particular acoustic characteristics.

21. The one or more non-transitory machine-readable storage devices of claim 20, wherein the first acoustic device is a portable wireless device and the second acoustic device is a hearing assistance device.

* * * * *